US008181679B2

(12) United States Patent
Vollenkemper

(10) Patent No.: US 8,181,679 B2
(45) Date of Patent: May 22, 2012

(54) APPARATUS FOR FILLING BAGS

(75) Inventor: Willi Vollenkemper, Oelde (DE)

(73) Assignee: Haver & Boecker OHG, Oelde (DE)

( * ) Notice: Subject to any disclaimer, the term of this patent is extended or adjusted under 35 U.S.C. 154(b) by 1155 days.

(21) Appl. No.: 11/962,309

(22) Filed: Dec. 21, 2007

(65) Prior Publication Data

US 2008/0156394 A1 Jul. 3, 2008

(30) Foreign Application Priority Data

Jan. 2, 2007 (DE) ..... 10 2007 001 308

(51) Int. Cl.
*B65B 1/04* (2006.01)

(52) U.S. Cl. ..... 141/315; 141/10; 141/74; 141/75; 141/76; 141/317

(58) Field of Classification Search ..... 141/10, 141/45, 73–78, 86, 158, 314–316, 317
See application file for complete search history.

(56) References Cited

U.S. PATENT DOCUMENTS

| | | | | |
|---|---|---|---|---|
| 4,047,546 | A | 9/1977 | Bassendale et al. | |
| 4,182,386 | A * | 1/1980 | Alack | 141/83 |
| 5,095,959 | A * | 3/1992 | Komassa et al. | 141/114 |
| 5,226,863 | A | 7/1993 | Kimura | |
| 5,322,095 | A | 6/1994 | Bolz | |
| 5,348,063 | A * | 9/1994 | Handleman | 141/314 |
| 5,413,157 | A * | 5/1995 | McGregor | 141/314 |
| 5,687,551 | A * | 11/1997 | Mustain et al. | 53/468 |
| 6,267,155 | B1 * | 7/2001 | Parks et al. | 141/18 |
| 6,708,734 | B2 * | 3/2004 | Rinehart | 141/12 |

FOREIGN PATENT DOCUMENTS

| | | |
|---|---|---|
| DE | 1586166 | 3/1971 |
| DE | 36 40 520 A1 | 6/1988 |
| DE | 9107768.0 U1 | 8/1992 |
| DE | 195 04 240 C1 | 11/1996 |
| DE | 10 2005 057 864 A1 | 6/2007 |

* cited by examiner

*Primary Examiner* — Timothy L Maust

(74) *Attorney, Agent, or Firm* — Pearne & Gordon LLP

(57) ABSTRACT

An apparatus for filling open bags with bulk materials, comprising a filling means and a filling spout having an outlet opening for filling the bags, wherein a collecting device is provided which includes a movable and controllable collecting unit. Said collecting unit, when in a collecting position, collects any bulk material which may trickle out of the outlet opening of the filling spout and when in a discharging position, discharges the collected bulk material into a material discharge line of a material discharge device.

14 Claims, 3 Drawing Sheets

APPARATUS FOR FILLING BAGS

Figure 1:
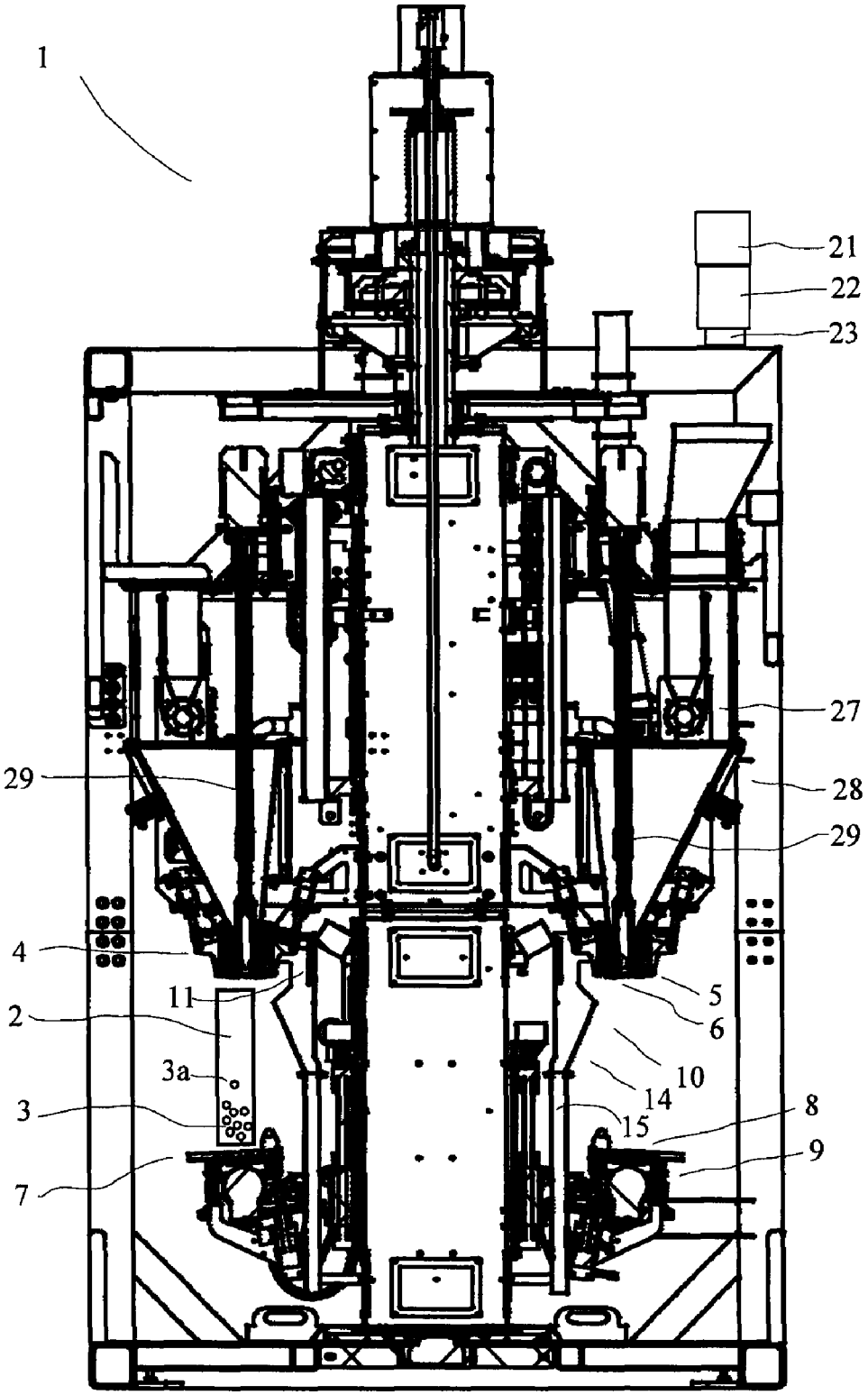

The invention relates to an apparatus for filling bags, and a collecting device for such a filling machine by means of which any bulk material trickling down after filling is collected. The invention may in particular relate to a form-fill-seal machine (FFS machine) for filling open bags wherein open tubes are formed from a tubular film which are then filled with bulk material and then sealed, and a collecting device to be used with such an FFS machine.

For the filling of open bags, different filling machines have become known in the prior art. Open bags are frequently filled by means of packaging machines with vertical filling spouts or filling pipes as the filling means. These packaging machines achieve very high filling rates for bulk materials such as granules, among other things due to that the material to be bagged can be filled into open bags over the entire or nearly the entire bag cross-section. For this reason these types lead to very high filling rates being considerably higher per filling tube per hour compared to other types of filling machines such as filling machines for valve bags.

The cleanliness of the filling machine and the ambience, as well as the cleanliness of the bagged material is of crucial importance these days for the bagging of bulk materials. Where the filled bags are e.g. sold in DIY stores to end users, their clean clothes should not be soiled when handling the bags. This requires clean bags.

What is a particular challenge is the filling of e.g. powdered products into open bags by means of so-called form-fill-seal machines because powdered products tend to cling to the vertical walls of a filling spout and then trickle down with each vibration, thus contaminating the machine or other bags.

Product particles and product dust trickling down are a problem e.g. in removing filled bags since the particles may be deposited directly on the outside surface of the removed bag or on the machinery, contaminating a bag due to air currents or in the case of contact with another bag. This is in particular adverse for bags of polyethylene film (PE film) since—due to static charging—cleaning dust off the outside bag surfaces is difficult.

In summary it must thus be found that this condition is not what customers expect.

To prevent the filling material from trickling down, these types of filling machines have been provided with suction devices by means of which an upstream current is built up inside the filling spout to thus cause the particles trickling down to return back upwardly and to be thus discharged. This often works in the case of lightweight dust or powders. It may occasionally happen though that caked materials are removed which cannot be sucked off in this way.

There have also been disclosed spout structures comprising a flap shutter. In the case of bagging powders, however, they provide a most unreliable sealing of the spout. In the case of fine powders or dusty materials, the sealing properties after filling will deteriorate over time because the filling material causes abrasions to the sealing surfaces.

The non-published German patent application 10 2005 057 864.0 describes a filling machine in which a vibrating table is used to support the bag and after the filling operation it is covered by a covering flap provided at the vibrating table so as to protect the vibrating table from contamination. Any bulk materials accumulated on the covering flap is thrown off in that said covering flap is pivoted upwardly before the next bag is placed, falling down onto the machinery beneath or on the floor. Although the covering flap keeps the vibrating table from being contaminated, it does not prevent contamination of other machinery elements or the ambience.

Therefore it is the object of the present invention to provide another apparatus for filling bags with bulk material wherein contamination of the bags and the filling machines is reduced.

This object is solved by an apparatus having the features of claim 1 and of claim 12 and by a device having the features of claim 13. Preferred embodiments are the subjects of the subclaims.

The apparatus according to the invention serves for filling in particular open bags with bulk material, comprising at least one filling means having at least one filling spout. The filling spout comprises at least one outlet opening for filling up the bags, through which the bulk material is conveyed into the bag to be filled. At least one collecting device is provided comprising at least one movable and controllable collecting unit, which collecting unit when in a collecting position collects the bulk material exiting from the outlet opening of the filling spout, and when in a discharging position discharges the collected bulk material into a material discharge line of a material discharge device.

The apparatus according to the present invention for filling bags has many advantages. The collecting device with the movable collecting unit allows, after a bag has been filled, for the collecting unit to be brought into the collecting position where the collecting unit collects any bulk material trickling down from the outlet opening of the filling spout.

By way of transferring to the discharging position before the next filling operation the collected bulk material is discharged in a controlled way into a material discharge line of a material discharge device. In this way not only the following bags are protected from contamination but the entire machine is protected from further contamination which has a positive effect on the cleanliness of the machine and the ambience and furthermore on the cleanliness of the filled bags. The discharged material may be fed to a material return for recycling or disposed of e.g. in the case of enhanced requirements for cleanliness.

The movable collecting unit is in particular configured such that the collecting unit drops material collected in the discharging position into the material discharge line such that the collected bulk material may be discharged by way of the effect of gravity.

In all of the embodiments the collecting device may comprise two or more in particular separate collecting units, and the material discharge device may comprise two or more material discharge lines, wherein each collecting unit is preferably provided with a separate material discharge line.

In a preferred more specific embodiment of the invention at least one filling position is provided in which the collecting unit enables the filling spout to fill the bags. The filling position may double as the discharging position such that only one movement is required between the collecting position and the discharging or filling position.

In other configurations it is possible and preferred for multiple different positions to be provided wherein in the filling position the collecting unit or part of the collecting unit rests against the bag to be filled so as to allow collecting any bulk material trickling down immediately at bag take-off.

It is advantageous for the collecting unit to be disposed immediately or at least substantially immediately beneath the outlet opening of the filling spout at least when in the collecting position to directly collect bulk material trickling down. The term "immediately" in the sense of the present application is understood to mean that a distance if any is short and in particular shorter than the maximum diameter of the filling spout or its outlet opening. Said distance is preferably shorter than 20 cm, in particular shorter than 10 cm and it may be 5 cm or only 2 cm or shorter still.

In preferred embodiments of the invention at least one supporting device having at least one supporting surface is provided to support during filling a bag to be filled from beneath. Said supporting device comprises in particular a vibrating device to compact during filling the feed material in the bag to be filled. This considerably accelerates the filling operation.

To obtain the cleanest possible bags, the vibrating table or the supporting surface ought to be clean to prevent the bags from being contaminated during filling. The configuration according to the invention wherein the collecting unit is positioned substantially directly beneath the filling spout, reliably prevents the bulk material from trickling out of the filling spout onto the vibrating table, thus obtaining clean bags.

The supporting device is preferably adjustable in height to accommodate the filling machine for different bag lengths.

In a preferred embodiment the material discharge device or each material discharge line comprises a suction device. The material discharge line may for example be used as an air suction such that any bulk material accumulated in the collecting unit can be sucked off in the discharging position.

In addition an upwardly air stream may be provided to be generated in or at the filling means to reduce or prevent any bulk material from trickling down after termination of the filling operation.

The material discharge device and in particular each material discharge line comprises in particular a collecting hopper which serves to take up the bulk material discharged from the collecting unit. The collecting unit may for example serve to discharge or drop the collected bulk material into the collecting hopper of the material discharge device wherein the shape of the hopper achieves a reliable take-up and forwarding of the entire bulk material.

In a specific embodiment of all of the embodiments described above the collecting unit is supported to pivot about a pivot axis, which pivot axis is in particular disposed above the outlet opening of the filling spout in a side region of the filling spout or at the take-up frame. In this way one can achieve a compact and simple structure. Preferably the vertical distance of the pivot axis from a take-up region of the collecting unit is at least 3 cm or at least 5 cm and in particular between 10 and 50 cm. The large pivot radius allows to obtain a defined discharge of the collecting unit at a precise location since the collecting position and the discharging position are disposed at separate locations.

In another embodiment the covering device is disposed to be movable linearly or along a pivoted guide link. In the case of a one-dimensional and e.g. linear or straight line of movement between the collecting and the discharging position, the discharged bulk material may, in the discharging position, be sucked off by means of a suction tube of the type of a vacuum cleaner tube. A pivoted guide link also allows a tilting movement.

Preferably the filling machine according to the invention comprises a controllable batch element and a net scale with a controllable outlet to weigh-batch the feeding of the bulk material to the bags.

The collecting unit of the collecting device in particular may be configured as a collecting tray, comprising e.g. a trough-shaped recess.

In all of the embodiments the filling spout is in particular not round on the whole but comprises one or multiple angles. Preferably the filling spout is hexagonal to enable a tight seat of an open bag on the spout which is pressed on the spout by six grippers equipped with rubber jaws or the like Since the inventive filling machine is in particular provided for processing gusseted bags, the hexagonal structure of the filling spout permits a particularly tight seat of the bag on the filling spout which due to the welded-off corners cannot be opened over its entire cross-section. Two sharp angles of the filling spout are provided to bear against the inside edges of the welded-off corners to thus guarantee a tight seat.

If the apparatus according to the invention provides for a supporting device as described above in the shape of e.g. a vibrating table, it may in addition to the collecting unit be provided with a movable and controllable covering device which in a filling position enables the supporting surface to support the bag and in a covering position, covers the supporting surface of the vibrating table. Such a covering device still further enhances protection from contamination since the covering device is then disposed beneath the collecting unit closely above the vibrating table, thus keeping any dust off the supporting surface of the vibrating table including to the side such that the bag bottom of a bag to be filled will remain particularly clean.

Preferably the covering device is disposed immediately above the supporting device at least in the covering position. This means that the provided distance from the supporting device is small to thus substantially guarantee that no dust or the like can be deposited on the seat from the side. The covering device may be configured in the shape of a bell to prevent dust from entering from the side.

Preferably the covering device is also disposed pivotable since pivoting movements are easy to realize. The pivot point is in particular provided to be in a side region of the covering device. The pivot point may be provided at a side end of the covering device. With the covering device additionally mounted to the supporting device, this will result in a particularly easy pivoting movement and a simple structure.

Another apparatus according to the invention for filling open bags with bulk material comprises at least one filling means and at least one filling spout having at least one outlet opening for filling the bags. There is furthermore provided at least one movable and controllable collecting unit which in a filling position enables the filling spout and in a collecting position immediately collects any bulk material exiting from the outlet opening of the filling spout. More specific embodiments may provide for said apparatus to comprise particular or all of the features of the apparatus described above.

The invention is furthermore directed at a collecting device for a filling machine comprising a filling spout for filling bags with bulk material which collecting device comprises a material discharge device and at least one movable and controllable collecting unit provided to collect any bulk material trickling out of the filling spout of the filling machine. Said collecting unit is suitable, when in a collecting position, to collect any bulk material which may exit from the filling spout and when in a discharging position, to discharge the collected bulk material into a material discharge line of the material discharge device.

The collecting device according to the invention also has many advantages. The collecting device according to the invention allows in particular a retrofitting of existing filling machines with a collecting device according to the invention, e.g. to manufacture one of the filling machines according to the invention described above by way of retrofitting. Retrofitting with the collecting device according to the invention thus allows to reliably prevent also in conventional filling machines the trickling down of bulk material from the filling spout after termination of the filling operation.

The collecting unit is in particular movable and in particular pivotable at least between the collecting position and the discharging position.

Preferably the collecting unit is of a quality and design so as to be suitable to be disposed immediately beneath the outlet opening of a filling spout at the filling machine.

The bulk material collected in the collecting unit can be reliably discharged in the discharging position by way of being dropped into a collecting hopper, wherein the conical or otherwise tapering shape of the collecting hopper ensures a reliable take-up and forwarding of the bulk material received in the collecting unit.

The collecting unit is moved between the collecting and the discharging position in particular by way of a pneumatic drive. What is also possible is employing a multi-stage cylinder by means of which separate collecting, discharging, and filling positions can be selected.

In particular specific embodiments the collecting unit bears against the bag to be filled in the filling position in that e.g. slight pressure is applied on the pneumatic drive cylinder which is small enough to reliably prevent damage to the bag to be filled. When at the end of the filling operation the bag is filled and taken off, the cylinder pressure directly causes the collecting unit to move to the collecting position. The bag may be protected by a protective rubber lip or the like provided at the collecting unit and bearing against the bag without doing any damage.

Further embodiments of the collecting device according to the invention may comprise further features as comprised in the collecting device of the filling machine described before.

Figure 2:
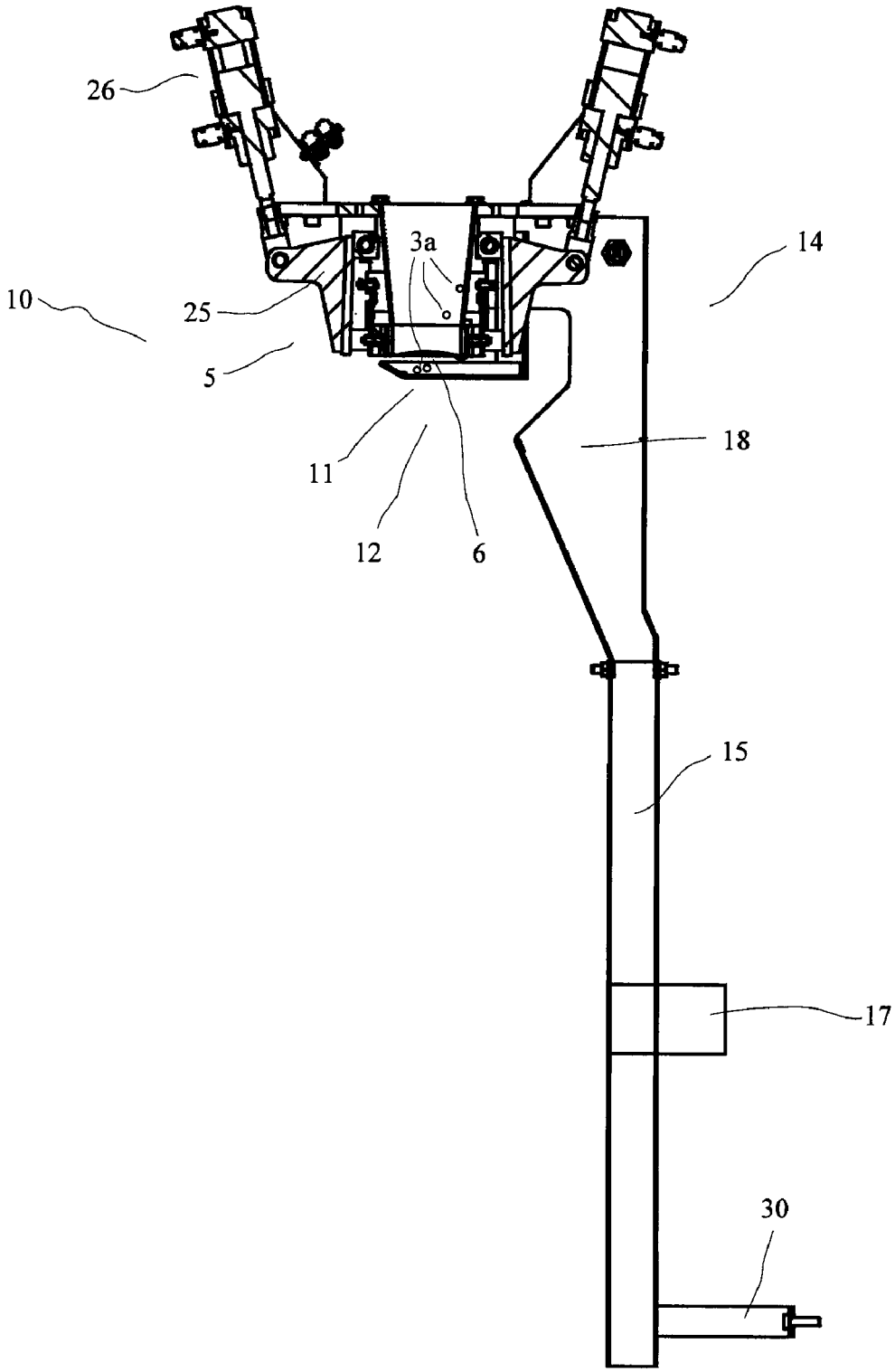
Figure 3:
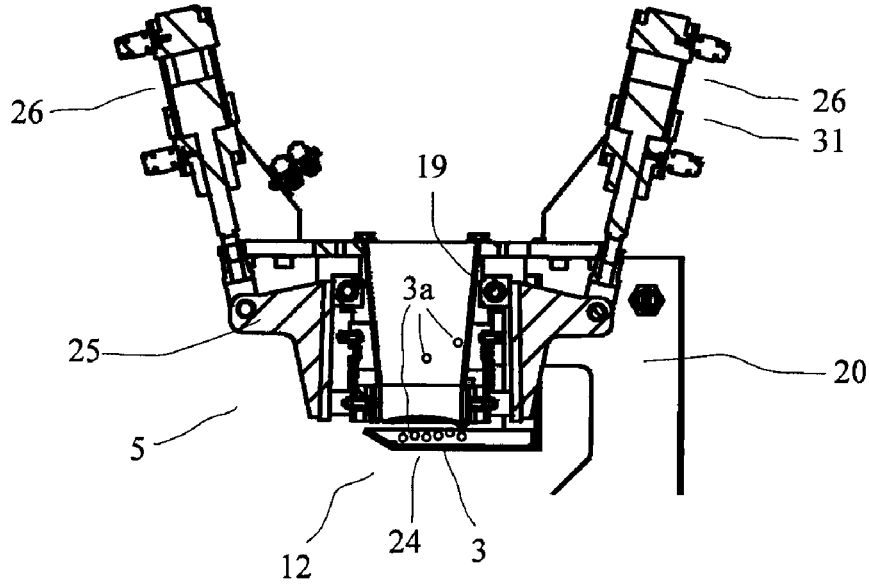
Figure 4:
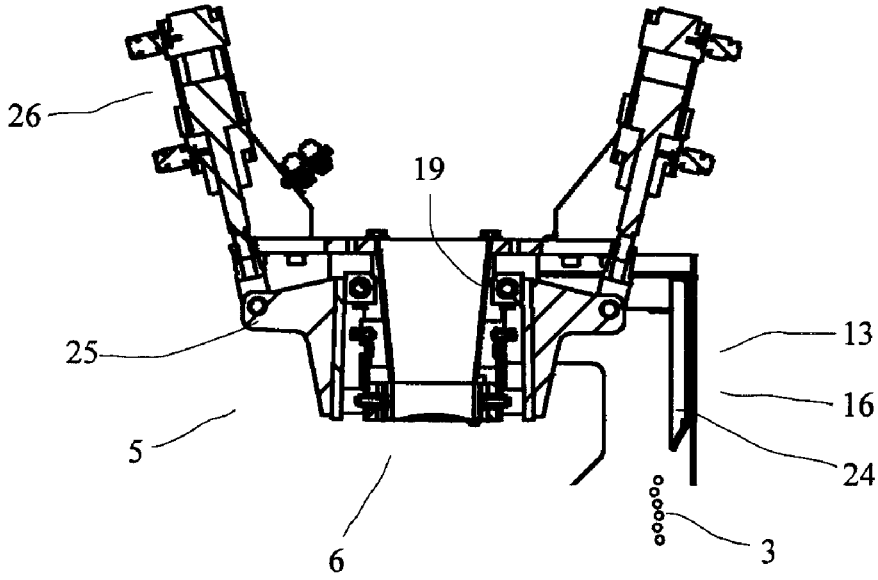

Further advantages and applications can be taken from the exemplary embodiment described below with reference to the enclosed Figures:

These show in:

FIG. 1 a schematic side view of the filling machine according to the invention, FIG. 2 a schematic view of the collecting device according to the invention of the filling machine according to FIG. 1, FIG. 3 an enlarged, schematic view of the filling spout and the collecting device according to FIG. 2 with the collecting tray in the collecting position, FIG. 4 an enlarged, schematic view of the filling spout and the collecting device according to FIG. 2 in the dropping position.

With reference to the FIGS. 1 to 4, an embodiment of the present invention will now be described. FIG. 1 shows a total view of an inventive filling machine 1 which, being a rotary filling machine is presently equipped with multiple filling means 4 configured as filling spouts 5 and evenly distributed over the periphery of the machine 1.

By means of a schematically illustrated batch element 21 and a schematically illustrated net scale 22, the bulk material 3 is batched and weighed. After a controllable outlet 23 is opened, the so-called "open bag" 2 firmly attached to and hanging off the filling spout 5 is filled across nearly the entire cross-section of the open bag 2 with the bulk material 3 which presently is e.g. a powder, comprising individual product particles 3*a*.

The bag 2 is only schematically illustrated in FIG. 1 between the filling spout 5 and the vibrating table 7. In an actual filling operation the bag 2 is hanging off the filling spout by its top end while its bottom end is supported on the vibrating table 7. The vibrating table 7 comprises a supporting surface 8 to support the bag 2 and a vibrating device 9 causing vibrating movements of the vibrating table to thus compact the bulk material 3 in the bag 2 and to accelerate the filling operation.

Since the fine powder such as cement might overflow if the entire batch were filled in the bag at once, because the bulk material to be bagged comprises a considerable proportion of air, only part of the provided batch is directly conveyed into the bag 2 through the collecting hopper 28 and the filling spout 5. A considerable portion of the batch is presently conveyed, precisely metered, through the rotary vane feeder 27 to the filling spout 5 to carefully monitor the filling speed.

To assist with compacting the bulk material 3 by way of the vibrating movements of the vibrating table 7, the vibrating beam 29 may additionally or alternatively be inserted from above into the bag 2 to compact the bulk material to be bagged during filling by way of the vibrating movements of the vibrating cylinder 29.

The filling machine 1 according to the invention is provided with a collecting device 10 comprising a collecting unit 11 and a material discharge device 14. The collecting unit 11 is shown in the illustration of FIG. 1 in the dropping position or the discharging position 13 in which any product particles 3*a* being on the collecting unit 11 are dropped into the collecting hopper 18 which passes into the material discharge device 15.

In FIG. 2 the region of the filling spout 5 and the collecting device 10 is enlarged. The collecting device 10 may be attached to the filling machine 1 by means of one or more angle brackets 30 or other attachment elements.

In the illustration of FIG. 2 the collecting unit 11 configured as a collecting tray 24 is in the collecting position 12, in which any product particles 3*a* trickling out of the opening 6 of the filling spout 5 are collected in the collecting tray 24, so as to reliably prevent contamination of other machinery by product particles trickling down.

The bag 2 not illustrated in FIG. 2 is clamped to the hexagonal filling spout 5 by means of grippers 25 operated with pneumatic cylinders 26 to ensure a tight seat of the bag 2 on the filling spout 5.

Before attaching the bag 2 to the filling spout 5, the collecting tray 24 is moved to the filling position 16; illustrated in FIG. 4, which in this embodiment is the same as the dropping position 13. Other exemplary embodiments may provide separate dropping and filling positions 13 and 16.

In this exemplary embodiment, a gripper 25 pivots around a pivot axis 19 provided at the filling spout 5 to thus secure the bag 2. The pivoting of the gripper 25 occurs through the pneumatic cylinder 26.

To transfer the collecting unit 11 from the collecting position 12 illustrated in FIG. 3 to the dropping position 13 illustrated in FIG. 4, a pneumatic cylinder 31 is employed to pivot the collecting tray 24 about the pivot axis 19. In this exemplary embodiment the collecting unit 11 also pivots about the pivot axis 19 shown on the right in FIG. 2. The pivoting of the collecting unit 11 can be controlled separately and independently of the pivoting of the gripper 25. At this point reference is made to that other embodiments may provide for separate pivot axes to pivot the collecting unit 11 and the gripper 25.

In this embodiment, the pneumatic cylinder 26 illustrated in FIG. 2 has a structurally identical pneumatic cylinder 31 disposed after it which causes the pivoting of the collecting unit 11. Other embodiments may provide for the pneumatic cylinder 31 in the illustration of FIG. 2 to be disposed after the filling spout 5.

The vertical distance between the outlet opening 6 and the collecting unit 11 in the collecting position is very small, only a few millimeters or centimeters, such that any product particles trickling down are reliably collected. The collecting unit 11 is disposed to be pivotable.

While the collecting tray 24 in the collecting position 12 is disposed substantially horizontal, the collecting tray 24 in the dropping position 13 takes a substantially vertical position which in the shown embodiment is rotated approximately 90° relative to the collecting position. Other exemplary embodiments may provide for a pivoting angle smaller than 90°, if discharge of the collected material is ensured. Pivoting angles larger than 90° are likewise possible to ensure a reliable discharge of the collected particles.

In all of the embodiments the material discharge line 15 may be provided with a suction device 17 to generate an air flow along the material discharge line to reliably convey the discharged particles of material along the material discharge line 15 and optionally to a collecting vessel to allow reuse or discharge of the product particles.

LIST OF REFERENCE NUMBERS

1 filling machine
2 bag
3 bulk material
3*a* product particles
4 filling means
5 filling spout
6 outlet opening
7 vibrating table
8 supporting surface
9 vibrating device
10 collecting device
11 collecting unit
12 collecting position
13 discharging position
14 material discharge device
15 material discharge line
16 filling position
17 suction device
18 collecting hopper
19 pivot axis
20 side region of the filling spout
21 batch element
22 net scale
23 controllable outlet
24 collecting tray
25 gripper
26 pneumatic cylinder
27 rotary vane feeder
28 collecting hopper
29 vibrating cylinder
30 angle bracket
31 pneumatic cylinder

The invention claimed is:

1. An apparatus (1) for filling open bags (2) with bulk materials (3), comprising at least one filling means (4) and at least one filling spout (5) having at least one outlet opening (6) for filling the bags (2), wherein a collecting device (10) is provided, comprising at least one movable and controllable collecting unit (11), which collecting unit (11) when in a collecting position (12) collects bulk material (3) trickling out of the outlet opening (6) of the filling spout (5) and when in a discharging position (13), discharges collected bulk material (3) into a material discharge line (15) of a material discharge device (14) and wherein the collecting unit (11) is supported to be pivotable about a pivot axis (19) which is in particular disposed above the outlet opening (6) of the filling spout (5) in a side region (20) of the filling spout (5).

2. The apparatus according to claim 1, wherein at least one filling position (16) is provided in which the collecting unit (11) enables the filling spout (5).

3. The apparatus according to claim 1, wherein the collecting unit (11) can be moved at least between the collecting position (12) and the discharging position (13).

4. The apparatus according to claim 1, wherein at least one supporting device (7) with a supporting surface (8) is provided for supporting from beneath the bags (2) to be filled during filling, which supporting device (7) in particular comprises a vibrating device (9) for compacting the feed material (3) in the bags (2) during filling.

5. The apparatus according to claim 1, wherein the collecting unit (11), at least when in the collecting position (12), is disposed immediately beneath the outlet opening (6) of the filling spout (5).

6. The apparatus according to claim 1, wherein the material discharge device (14) comprises a suction device (17).

7. The apparatus according to claim 1, wherein the material discharge device (14) comprises a collecting hopper (18).

8. The apparatus according to claim 1, wherein a controlled batch element (21) and a net scale (22) with a controllable outlet (23) are provided.

9. The apparatus according to claim 1, wherein the collecting unit (11) is configured as a collecting tray (24).

10. A collecting device (10) for a filling machine (1) comprising a filling spout (5) for filling open bags (2) with bulk material (3), wherein a material discharge device (14) and at least one movable and controllable collecting unit (11) are provided for collecting any bulk material (3) trickling down from the filling spout (5) of the filling machine (1) after filling, wherein the collecting unit (11) when in a collecting position (12) is suitable to collect bulk material (3) trickling out of the filling spout (5) and when in a discharging position (13) to discharge collected bulk material (3) into a material discharge line (15) of the material discharge device (14) and wherein the collecting unit (11) is supported to be pivotable about a pivot axis (19) which is in particular disposed above the outlet opening (6) of the filling spout (5) in a side region (20) of the filling spout (5).

11. The collecting device (10) according to claim 10, wherein the collecting unit (11) can be moved at least between the collecting position (12) and the discharging position (13).

12. The collecting device (10) according to claim 10, wherein the material discharge device (14) comprises a suction device (17).

13. An apparatus (1) for filling open bags (2) with bulk materials (3), comprising at least one filling means (4) and at least one filling spout (5) having at least one outlet opening (6) for filling the bags (2), wherein a collecting device (10) is provided, comprising at least one movable and controllable collecting unit (11), which collecting unit (11) when in a collecting position (12) collects bulk material (3) trickling out of the outlet opening (6) of the filling spout (5) and when in a discharging position (13), discharges collected bulk material (3) into a material discharge line (15) of a material discharge device (14) and wherein the collecting unit (11) is disposed to be linearly movable.

14. An apparatus (1) for filling open bags (2) with bulk materials (3), comprising at least one filling means (4) and at least one filling spout (5) having at least one outlet opening (6) for filling the bags (2), wherein a movable and controllable collecting unit (11) is provided which when in a filling position (16) enables the filling spout (5) and when in a collecting position (12) immediately collects any bulk materials (3) trickling out of the outlet opening (6) of the filling spout (5) and wherein the collecting unit (11) is supported to be pivotable about a pivot axis (19) which is in particular disposed above the outlet opening (6) of the filling spout (5) in a side region (20) of the filling spout (5).

* * * * *